US006864843B2

(12) United States Patent
du Toit et al.

(10) Patent No.: US 6,864,843 B2
(45) Date of Patent: Mar. 8, 2005

(54) CONFORMAL FREQUENCY-AGILE TUNABLE PATCH ANTENNA

(75) Inventors: Cornelis Frederik du Toit, Ellicott City, MD (US); Ernest P. Ekelman, Damascus, MD (US)

(73) Assignee: Paratek Microwave, Inc., Columbia, MD (US)

( * ) Notice: Subject to any disclaimer, the term of this patent is extended or adjusted under 35 U.S.C. 154(b) by 0 days.

(21) Appl. No.: 10/641,835

(22) Filed: Aug. 14, 2003

(65) Prior Publication Data

US 2004/0113842 A1 Jun. 17, 2004

Related U.S. Application Data

(60) Provisional application No. 60/403,848, filed on Aug. 15, 2002.

(51) Int. Cl.[7] ..... H01Q 1/38

(52) U.S. Cl. ..... 343/700 MS; 343/745; 343/702

(58) Field of Search ..... 343/700 MS, 702, 343/745, 846, 848; 333/204, 205

(56) References Cited

U.S. PATENT DOCUMENTS

| | | | | | |
|---|---|---|---|---|---|
| 4,751,513 | A | * | 6/1988 | Daryoush et al. | 343/700 MS |
| 5,312,790 | A | | 5/1994 | Sengupta et al. | 501/137 |
| 5,427,988 | A | | 6/1995 | Sengupta et al. | 501/137 |
| 5,486,491 | A | | 1/1996 | Sengupta et al. | 501/137 |
| 5,593,495 | A | | 1/1997 | Masuda et al. | 117/4 |
| 5,635,433 | A | | 6/1997 | Sengupta | 501/137 |
| 5,635,434 | A | | 6/1997 | Sengupta | 501/138 |
| 5,640,042 | A | | 6/1997 | Koscica et al. | 257/595 |
| 5,693,429 | A | | 12/1997 | Sengupta et al. | 428/699 |
| 5,694,134 | A | | 12/1997 | Barnes | 343/700 |
| 5,766,697 | A | | 6/1998 | Sengupta et al. | 427/585 |
| 5,830,591 | A | | 11/1998 | Sengupta et al. | 428/701 |
| 5,846,893 | A | | 12/1998 | Sengupta et al. | 501/137 |
| 5,886,867 | A | | 3/1999 | Chivukula et al. | 361/311 |
| 5,943,016 | A | * | 8/1999 | Snyder et al. | 343/700 MS |
| 5,990,766 | A | | 11/1999 | Zhang et al. | 333/205 |
| 6,074,971 | A | | 6/2000 | Chiu et al. | 501/139 |
| 6,362,789 | B1 | * | 3/2002 | Trumbull et al. | 343/700 MS |
| 6,377,142 | B1 | | 4/2002 | Chiu et al. | 333/238 |
| 6,377,217 | B1 | | 4/2002 | Zhu et al. | 343/700 |
| 6,377,440 | B1 | | 4/2002 | Zhu et al. | 361/311 |
| 6,404,614 | B1 | | 6/2002 | Zhu et al. | 361/277 |
| 6,492,883 | B2 | | 12/2002 | Liang et al. | 333/132 |
| 6,514,895 | B1 | | 2/2003 | Chiu et al. | 501/137 |
| 6,525,630 | B1 | | 2/2003 | Zhu et al. | 333/205 |
| 6,531,936 | B1 | | 3/2003 | Chiu et al. | 333/164 |
| 6,535,076 | B2 | | 3/2003 | Partridge et al. | 333/17.1 |
| 6,538,603 | B1 | | 3/2003 | Chen et al. | 342/372 |
| 6,556,102 | B1 | | 4/2003 | Sengupta et al. | 333/161 |
| 6,590,468 | B2 | | 7/2003 | du Toit et al. | 333/17.3 |
| 6,597,265 | B2 | | 7/2003 | Liang et al. | 333/204 |
| 6,614,399 | B2 | * | 9/2003 | Trumbull et al. | 343/702 |
| 6,680,703 | B1 | * | 1/2004 | McConnell | 343/700 MS |

* cited by examiner

*Primary Examiner*—Tan Ho
(74) *Attorney, Agent, or Firm*—William J. Tucker; James S. Finn

(57) ABSTRACT

A tunable patch antenna is described herein that includes a ground plane on which there is located a substrate and on which there is located a patch. The patch is split into two parts (e.g., rectangular parts) which are connected to one another by one or more voltage-tunable series capacitors. Each part has a radiating edge which is connected to one or more voltage-tunable edge capacitors. Also described herein, is a method for electronically tuning the tunable patch antenna to any frequency within a band of operation which is in a range of about 30% of the center frequency of operation.

27 Claims, 5 Drawing Sheets

CONFORMAL FREQUENCY-AGILE TUNABLE PATCH ANTENNA

CLAIMING BENEFIT OF PRIOR FILED PROVISIONAL APPLICATION

This application claims the benefit of U.S. Provisional Application Ser. No. 60/403,848 filed on Aug. 15, 2002 and entitled "Conformal, Frequency-Agile, Tunable Patch Antennas" the contents of which are hereby incorporated by reference herein.

BACKGROUND OF THE INVENTION

1. Field of the Invention

This invention relates to the communications field, and more particularly to a tunable patch antenna that has a tuning range of up to 30% of the center frequency of operation $f_{center}$, the latter being anywhere between about 30 MHz to 40 GHz.

2. Description of Related Art

Today there is a lot of research going on industry to develop a tunable patch antenna that can be electronically tuned to any frequency within a wide band of operation. One traditional tunable patch antenna is tuned by semiconductor varactor diodes but this antenna suffers from several problems including: (1) linearity problems; and (2) power handling problems. Another traditional tunable patch antenna is tuned by MEMS switches but this antenna suffers from several problems including: (1) power handling problems; (2) undefined reliability since the MEMS switches are mechanical devices suffering from fatigue after repetitive use; and (3) the resonant frequency of the antenna cannot be continuously scanned between two points, since the MEMS switches are basically binary devices. Yet another traditional tunable patch antenna is tuned by voltage-tunable edge capacitors and has a configuration as shown in FIGS. 1A and 1B.

Referring to FIGS. 1A and 1B (PRIOR ART), there are respectively shown a perspective view and a side view of a traditional tunable patch antenna 100 that is tuned by voltage-tunable edge capacitors 102. The tunable patch antenna 100 includes a ground plane 104 on which there is located a substrate 106 on which there is located a patch 108. The patch 108 has two radiating edges 110*a* and 110*b* on which there are attached multiple voltage-tunable edge capacitors 102 (six shown). In operation, a radio frequency (RF) signal 111 is applied to a RF feedpoint 112. And, a DC bias voltage 114 is applied to the patch and the voltage-tunable edge capacitors 102. The tunable patch antenna 100 has a resonant frequency at its lowest frequency when it is in an unbiased state or when no DC bias voltage 114 is applied to the voltage-tunable edge capacitors 102. But when a DC bias voltage 114 is applied to the voltage-tunable edge capacitors 102, then the voltage-tunable edge capacitors 102 change their electrical properties and capacitance in a way such that when there is an increase in the magnitude of the DC bias voltage 114 then there is an increase in the resonant frequency of the tunable patch antenna 100. In this way, the tunable patch antenna 100 can be electronically tuned to any frequency within a band of operation in a range of up to 15% of the center frequency of operation $f_{center}$. FIG. 2 shows a graph of a theoretical input reflection [dB] versus frequency [GHz] for the tunable patch antenna 100. Although the traditional tunable patch antenna 100 works fine in most applications it would be desirable to have a tunable patch antenna that can be electronically tuned to any frequency within a larger band of operation which is in a range of up to 30% of the center frequency of operation $f_{center}$. This need and other needs have been satisfied by the tunable patch antenna of the present invention.

BRIEF DESCRIPTION OF THE INVENTION

The present invention includes a tunable patch antenna and a method for electronically tuning the tunable patch antenna to any frequency within a band of operation which is in a range of about 30% of the center frequency of operation $f_{center}$. The tunable patch antenna includes a ground plane on which there is located a substrate on which there is located a patch. The patch is split into two parts, (e.g., rectangular parts) which are connected to one another by one or more voltage-tunable series capacitors. Each part has a radiating edge, which is connected to one or more voltage-tunable edge capacitors. In operation, a RF signal is applied to a RF feedpoint on the patch. And, a DC bias voltage is applied to the voltage-tunable series and edge capacitors. The tunable patch antenna has a resonant frequency at its lowest frequency when it is in an unbiased state or when no DC bias voltage is applied to the voltage-tunable series and edge capacitors. But when a DC bias voltage is applied to the voltage-tunable series and edge capacitors, then the voltage-tunable edge and series capacitors change their electrical properties and capacitance in a way such that when there is an increase in the magnitude of the DC bias voltage then there is an increase in the resonant frequency of the tunable patch antenna. In this way, the tunable patch antenna can be electronically tuned to any frequency within a band of operation in a range of about 30% of the center frequency of operation $f_{center}$.

BRIEF DESCRIPTION OF THE DRAWINGS

A more complete understanding of the present invention may be obtained by reference to the following detailed description when taken in conjunction with the accompanying drawings wherein.

DETAILED DESCRIPTION OF THE DRAWINGS

Figure 2:
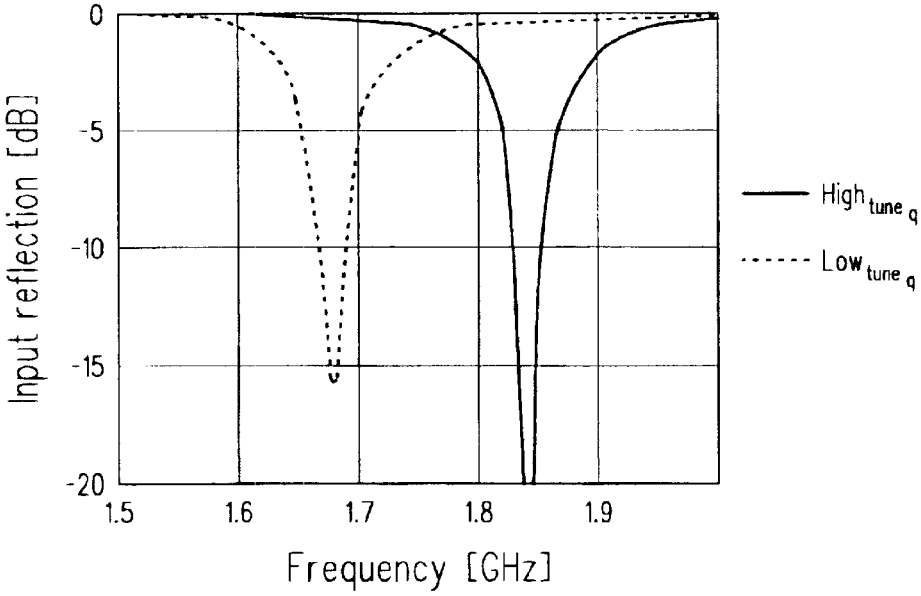
FIG. 2 (PRIOR ART)
FIG. 2 (PRIOR ART) is a graph showing typical theoretical values of an input reflection [dB] versus frequency [GHz] of the traditional tunable patch antenna shown in FIG. 1, assuming a certain amount of tunability in the edge capacitors 102.
Figure 3:
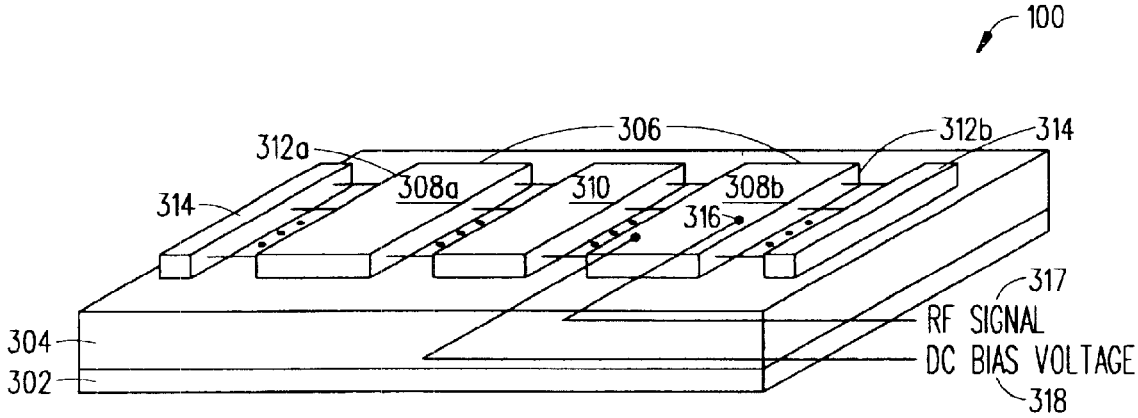
FIG. 3 is a perspective illustrating the basic components of a tunable patch antenna in accordance with the present invention.
Figure 4:
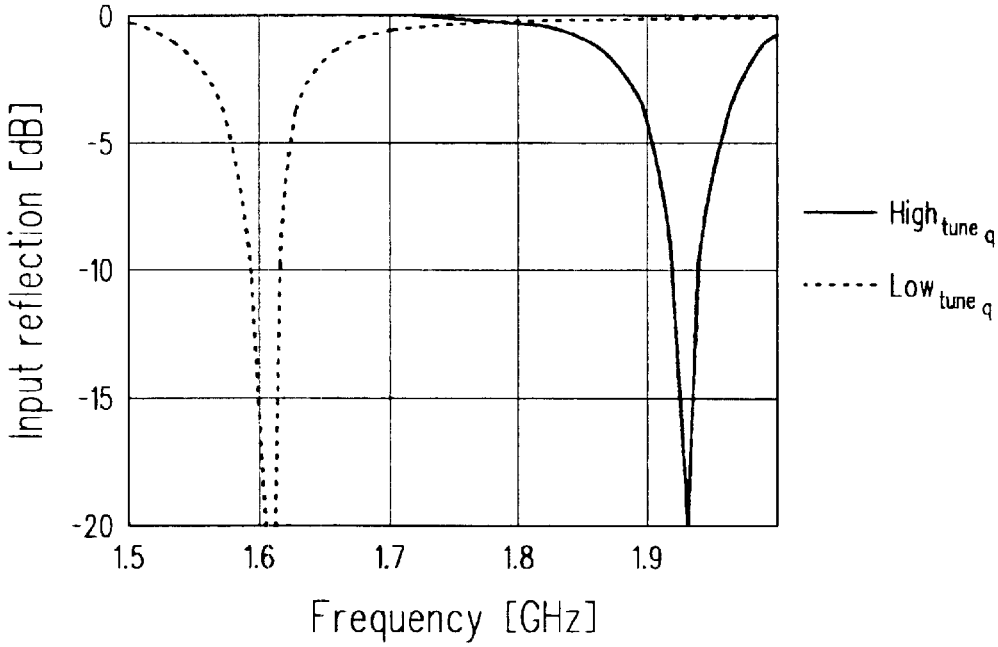
FIG. 4 is a graph showing typical theoretical values of an input reflection [dB] versus frequency [GHz] of the tunable patch antenna shown in FIG. 3, assuming the same amount of tunability in the capacitors 310 and 314 as assumed previously for capacitors 102 in calculating the results of FIG. 2.

Referring to FIG. 3, there is a perspective view illustrating the basic components of a tunable patch antenna 300 in accordance with the present invention. The tunable patch antenna 300 includes a ground plane 302 on which there is located a substrate 304 on which there is located a patch 306. The patch 306 is split into two parts 308*a* and 308*b* (shown as rectangular parts 308*a* and 308*b*) which are connected to one another by one or more voltage-tunable series capacitors 310. Each part 308*a* and 308*b* has a radiating edge 312*a* and 312*b* each of which is connected to one or more voltage-tunable edge capacitors 314. In operation, a RF signal 317 is applied to a RF feedpoint 316 on the patch 306. And, a DC bias voltage 318 is applied to the voltage-tunable series and edge capacitors 310 and 314. The tunable patch antenna 300 has a resonant frequency at its lowest frequency when it is in an unbiased state or when no DC bias voltage 318 is applied to the voltage-tunable series and edge capacitors 310 and 314. But when a DC bias voltage 318 is applied to the voltage-tunable series and edge capacitors 310 and 314, then the voltage-tunable edge and series capacitors 310 and 314 change their electrical properties and capacitance in a way such that when there is an increase in the magnitude of the DC bias voltage 318 then there is an increase in the resonant frequency of the tunable patch antenna 300. In this way, the tunable patch antenna 300 can be electronically tuned to any frequency within a band of operation in a range of about up to 30% of the center frequency of operation $f_{center}$. FIG. 4 shows a graph of a typical theoretical input reflection [dB] versus frequency [GHz] for the tunable patch antenna 300 (compare with graph shown in FIG. 2).

Figure 1A:
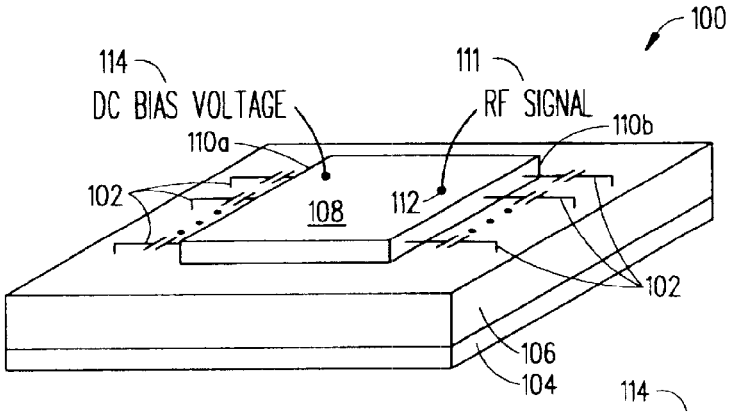
FIG. 1A (PRIOR ART)
FIGS. 1A and 1B (PRIOR ART) are respectively a perspective view and a side view of a traditional tunable patch antenna.
Figure 1B:
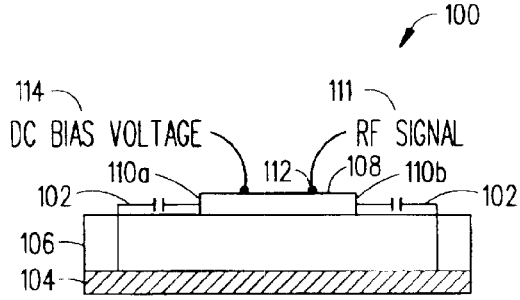
FIG. 1B (PRIOR ART)
Figure 5A:
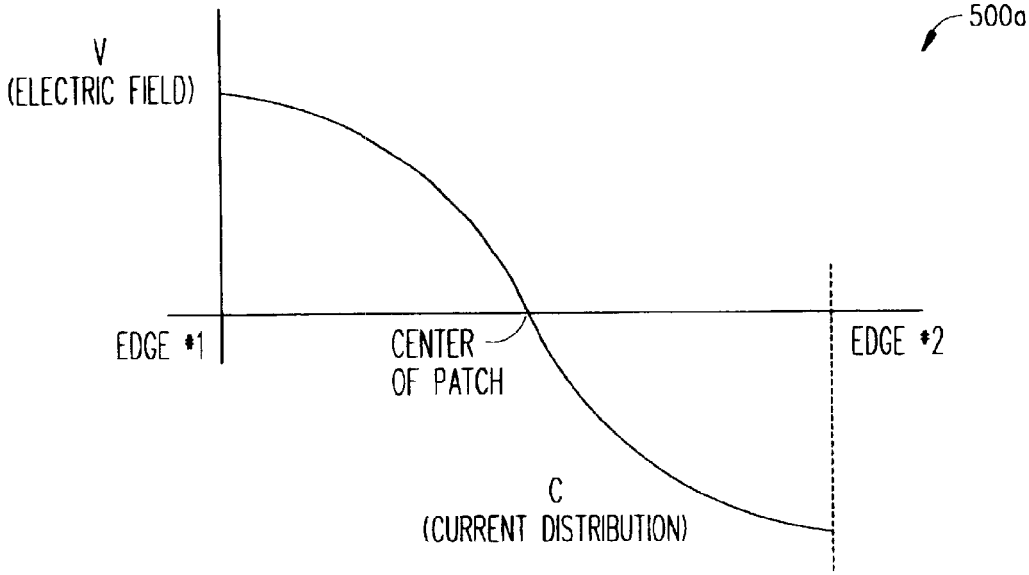
FIGS. 5A–5B illustrate two graphs that are used to explain why the tunable patch antenna shown in FIG. 3 can be electronically tuned to a frequency within a band of operation that is larger than the band of operation associated with the traditional tunable patch antenna shown in FIG. 1.
Figure 5B:
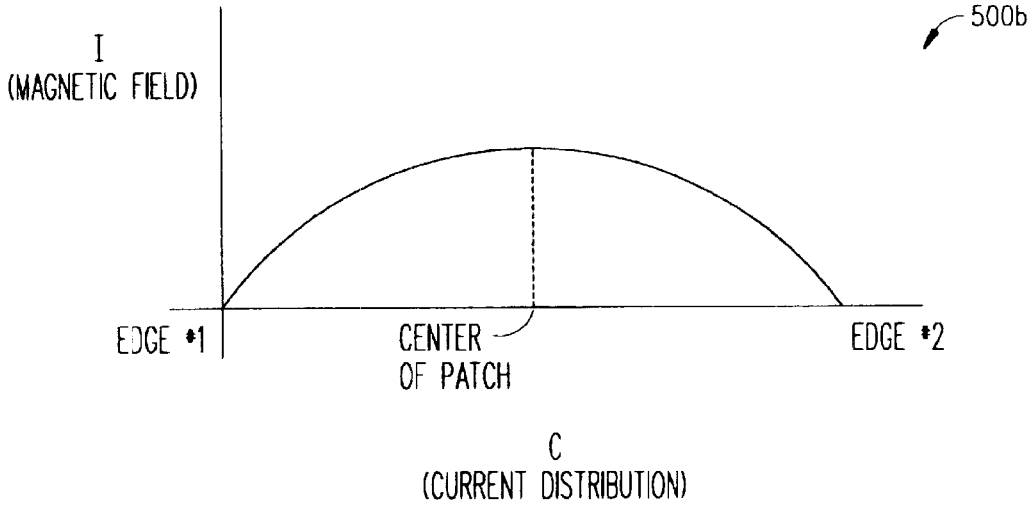

Referring to FIGS. 5A–5B, there are shown two graphs 500*a* and 500*b* that are used to explain why the tunable patch antenna 300 can be electronically tuned to a frequency within a band of operation that is larger than the band of operation associated with the traditional tunable patch antenna 100 (see FIGS. 1A and 1B). FIG. 5A is a graph 500*a* that shows the voltage distribution across the patch 306, which indicates that the voltage-tunable edge capacitors 314 are located at the radiating edges 312*a* and 312*b* where most of the electric energy of the patch 306 is stored. Some of this electrical field energy will be stored in the tunable edge capacitors 314. Therefore the stored electric energy and hence the resonant frequency is affected when the capacitors 314 are tuned. FIG. 5B is a graph 500*b* that shows the current distribution across the patch 306 which indicates that the voltage-tunable series capacitors 310 are located at the center of the patch where most of the magnetic energy of the patch 306 is stored in the form of electric currents. Since these currents flow through the series capacitors 310, some of this energy is stored in the capacitors 310 in the form of magnetic energy. Therefore the stored magnetic energy and hence the resonant frequency is affected when the capacitors 310 are tuned. As can be seen in the two graphs 500*a* and 500*b*, at one moment there is maximum energy in the electric field and nothing in the magnetic field and one quarter cycle later there is maximum energy in the magnetic field and nothing in the electric field. This condition indicates that the voltage-tunable edge capacitors 314 store electrical energy when the voltage-tunable series capacitors 310 do not store magnetic energy. And, the voltage-tunable edge capacitors 314 do not store electrical energy when the voltage-tunable series capacitors 310 store magnetic energy. As such, the voltage-tunable series and edge capacitors 310 and 314 can continuously store energy and by applying a DC bias voltage 316 to change the capacitance of the capacitors 310 and 314 one increases the tunability of the tunable patch antenna 300. This is a marked improvement over the traditional tunable patch antenna 100 which only has the voltage-tunable edge capacitors 102, which means that only the stored electric field energy is affected by tuning capacitors 102, while no magnetic field energy is affected. Accordingly, the traditional tunable patch antenna 100 can not be tuned over a frequency band of operation as wide as that of the tunable patch antenna 300. For instance, assuming a certain tunability for the capacitors 102, 310 and 314, the traditional tunable patch antenna 100 can be electronically tuned to any frequency within a band of operation in a range of about +/−85 MHz as shown in FIG. 2, while the tunable patch antenna 300 can be electronically tuned to any frequency within a band of operation in a range of about +/−160 MHz as shown in FIG. 4.

Figure 6:
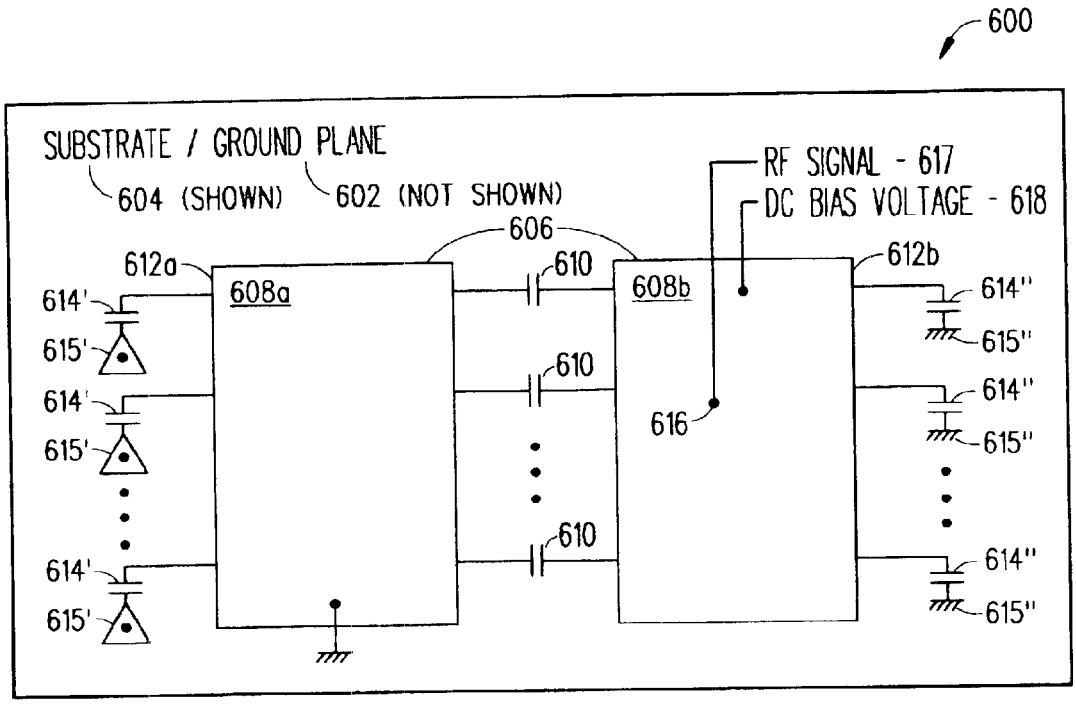
FIG. 6 is a block diagram illustrating the basic components of a first embodiment of the tunable patch antenna shown in FIG. 3.

Referring to FIG. 6, there is a block diagram illustrating the basic components of a first embodiment of a tunable patch antenna 600 in accordance with the present invention. The tunable patch antenna 600 includes a ground plane 602 on which there is located a substrate 604 on which there is located a patch 606. The patch 606 is split into two parts 608*a* and 608*b* (shown as rectangular parts 608*a* and 608*b*) which are connected to one another by individual voltage-tunable series capacitor(s) 610 (only three shown, about $0.005/f_{center}$ to $0.05/f_{center}$ Farads in total). Each part 608*a* and 608*b* has a radiating edge 612*a* and 612*b*, which is connected to individual voltage-tunable edge capacitors 614 (only six shown). In particular, the first part 608*a* has the radiating edge 612*a* which is connected to individual voltage-tunable edge capacitor(s) 614' (e.g. about $0.01/f_{center}$ to $0.1/f_{center}$ Farads in total) that are connected to virtual/RF ground 615". And, the second part 608*b* has the radiating edge 612*b* which is connected to individual voltage-tunable edge capacitor(s) 614" (e.g. about $0.01/f_{center}$ to $0.1/f_{center}$ Farads in total) that are connected to physical ground 615". In this embodiment, the voltage-tunable edge capacitor(s) 614" are shunt capacitors to ground. In operation, a RF signal 617 is applied to a RF feedpoint 616 on the patch 606. And, a DC bias voltage 618 is applied to the voltage-tunable series and edge capacitors 610 and 614 by applying it to patch part 608*b* and the virtual RF ground points 615'. The tunable patch antenna 600 has a resonant frequency at its lowest frequency when it is in an unbiased state or when no DC bias voltage 618 is applied to the voltage-tunable series and edge capacitors 610 and 614. But when a DC bias voltage 618 is applied to the voltage-tunable series and edge capacitors 610 and 614, then the voltage-tunable edge and series capacitors 610 and 614 change their electrical properties and capacitance in a way such that when there is an increase in the magnitude of the DC bias voltage 618, then there is an increase in the resonant frequency of the tunable patch antenna 600. In this way, the tunable patch antenna 600 can be electronically tuned to any frequency within a band of operation in a range of up to 30% of the center frequency of operation $f_{center}$.

Figure 7:
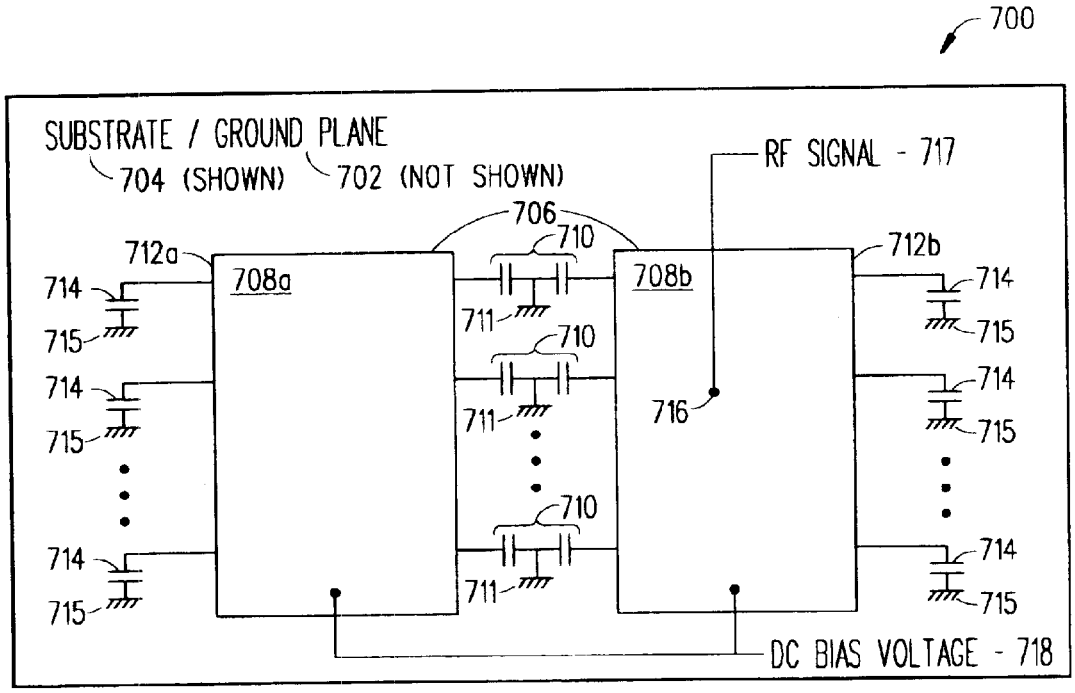
FIG. 7 is a block diagram illustrating the basic components of a second embodiment of the tunable patch antenna shown in FIG. 3.

Referring to FIG. 7, there is a block diagram illustrating the basic components of a second embodiment of a tunable patch antenna 700 in accordance with the present invention. The tunable patch antenna 700 includes a ground plane 702 on which there is located a substrate 704 on which there is located a patch 706. The patch 706 is split into two parts 708*a* and 708*b* (shown as rectangular parts 708*a* and 708*b*) which are connected to one another by one or more pairs of voltage-tunable series capacitors 710 (only three shown). Each pair of voltage-tunable series capacitors 710 (e.g. about $0.005/f_{center}$ to $0.05/f_{center}$ Farads in total) are connected to physical ground 711. As shown, the connection to the physical ground 711 is made in the middle of the pair of voltage-tunable series capacitors 710. This is possible because the voltage is zero in the middle of the patch 706 (see FIG. 5A). Each part 708*a* and 708*b* has a radiating edge 712*a* and 712*b* which is connected to individual voltage-tunable edge capacitors 714. (only six shown). Each voltage-tunable edge capacitor 714 (e.g. about $0.01/f_{center}$ to $0.1/f_{center}$ Farads in total) is connected to physical ground 715. In operation, a RF signal 717 is applied to a RF feedpoint 716 on the patch 706. And, a DC bias voltage 718 is applied to the voltage-tunable series and edge capacitors 710 and 714. The tunable patch antenna 700 has a resonant frequency at its lowest frequency when it is in an unbiased state or when no DC bias voltage 718 is applied to the voltage-tunable series and edge capacitors 710 and 714. But when a DC bias voltage 718 is applied to the voltage-tunable series and edge capacitors 710 and 714, then the voltage-tunable edge and series capacitors 710 and 714 change their electrical properties and capacitance in a way such that when there is an increase in the magnitude of the DC bias voltage 718 then there is an increase in the resonant frequency of the tunable patch antenna 700. In this way, the tunable patch antenna 700 can be electronically tuned to any frequency within a band of operation in a range of about 30% of the center frequency of operation $f_{center}$.

Figure 8:
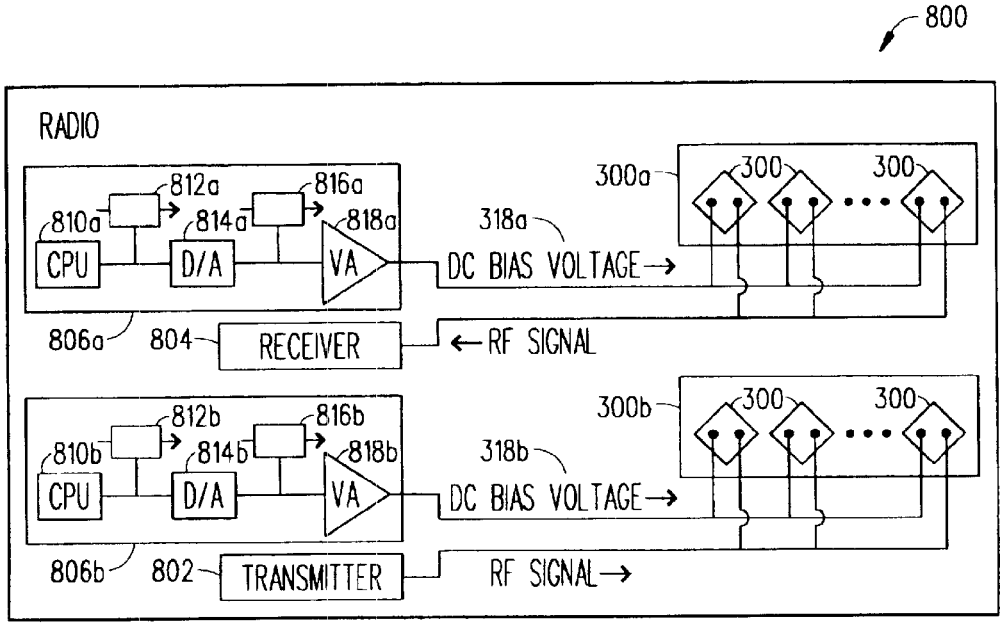
FIG. 8 is a block diagram illustrating the basic components of a radio incorporating multiple tunable patch antennas shown in FIG. 3.

Referring to FIG. 8, there is shown a block diagram illustrating the basic components of a radio 800 incorporating two arrays of the tunable patch antennas 300 shown in FIG. 3. For clarity, the radio 800 is described below with respect to using the tunable patch antenna 300. However, it should be understood that the radio 800 can also incorporate tunable patch antennas 600 and 700 (see FIGS. 6–7). The radio 800 includes a transmitter 802 and a receiver 804 which are respectively attached to one or more tunable patch antennas 300 (shown as arrays of tunable patch antennas 300*a* and 300*b*). The radio 800 also includes one or two antenna control systems 806*a* and 806*b* (two shown). Each antenna control system 806*a* and 806*b* includes a processor 810*a* and 810*b* (e.g., central processing unit 810*a* and 810*b*) which calculates the magnitude of the DC bias voltage 318*a* and 318*b* and outputs a corresponding digital signal 812*a* and 812*b*. A digital-to-analog converter 814*a* and 814*b* converts the digital signal 812*a* and 812*b* into an analog signal 816*a* and 816*b*. A voltage amplifier 818*a* and 818*b* then amplifies the analog signal 816*a* and 816*b* to an appropriate magnitude which is the DC bias voltage 318*a* and 318*b* that is applied to the tunable patch antennas 300*a* and 300*b*. It should be appreciated that the radio 800 may include just the transmitter 802 or just the receiver 804.

Figure 9:
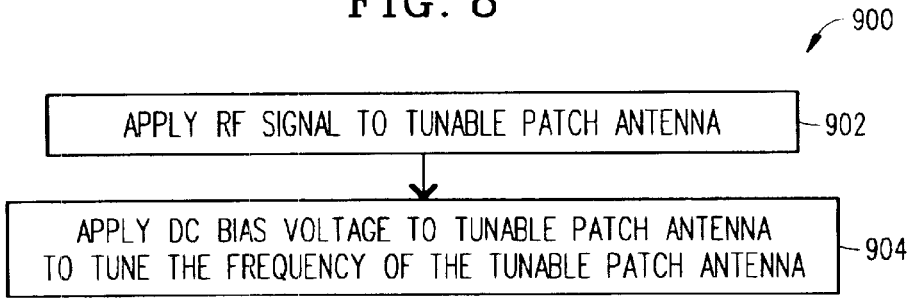
FIG. 9 is a flowchart illustrating the steps of a preferred method for tuning a frequency of the tunable patch antennas shown in FIGS. 3, 6 and 7 in accordance with the present invention.

Referring to FIG. 9, there is a flowchart illustrating the steps of a preferred method 900 for tuning a frequency of the tunable patch antenna 300, 600 and 700 in accordance with the present invention. For clarity, the method 900 is described below with respect to using the tunable patch antenna 300. However, it should be understood that the method 900 can be used to tune the tunable patch antennas 600 and 700 (see FIGS. 6 and 7). Beginning at step 902, a RF signal 317 is applied to the tunable patch antenna 300 and in particular to one of the parts 308*a* and 308*b* of the patch 306 (see FIG. 3). At step 904, a DC bias voltage 318 is applied to the voltage-tunable series and edge capacitors 310 and 314 to tune the frequency of the tunable patch antenna 300. How the DC bias voltage 318 is generated is described above with respect to FIG. 8. It should be appreciated that the tunable patch antennas 300, 600 and 700 can receive a DC bias voltage 318, 618 and 718 and a radio frequency signal 317, 617 and 717 at the same time and then emit a beam that can have anyone of a number of radiation patterns including, for example with appropriate application of the described technique, an omni-directional radiation pattern, a vertically polarized radiation pattern, a linear polarized radiation pattern or a circular/elliptical polarized radiation pattern.

Figure 10A:
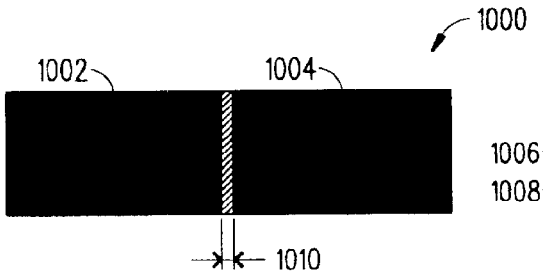
FIGS. 10A and 10B respectively show a top view and a cross-sectional side view of an exemplary voltage-tunable capacitor that is representative of the type of structure that the voltage-tunable series and edge capacitors can have which are used in the tunable patch antennas shown in FIGS. 3, 6 and 7.
Figure 10B:
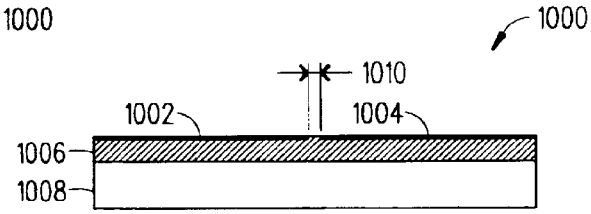

A more detailed discussion about the structure of the voltage-tunable series and edge capacitors 310, 314, 610, 614, 710 and 714 are provided below with respect to FIGS. 10A and 10B. FIGS. 10A and 10B respectively show a top view and a cross-sectional side view of an exemplary voltage-tunable capacitor 1000 that can be representative of the voltage-tunable series and edge capacitors 310, 314, 610, 614, 710 and 714.

The voltage-tunable capacitor 1000 includes a pair of metal electrodes 1002 and 1004 positioned on top of a voltage tunable dielectric layer 1006 which is positioned on top of a substrate 1008. The substrate 1008 may be any type of material that has a relatively low permittivity (e.g., less than about 30) such as MgO, Alumina, $LaAlO_3$, Sapphire, or ceramic. The voltage tunable dielectric layer 1006 is a material that has a permittivity in a range from about 20 to about 2000, and has a tunability in a range from about 10% to about 80% at a maximum DC bias voltage 318, 618 and 718 of up to 20 V/$\mu$m. In the preferred embodiment, this layer is comprised of Barium-Strontium Titanate, $Ba_xSr_{1-x}TiO_3$ (BSTO), where x can range from zero to one, or BSTO-composite ceramics. Examples of such BSTO composites include, but are not limited to: BSTO—MgO, BSTO—$MgAl_2O_4$, BSTO—$CaTiO_3$, BSTO—$MgTiO_3$, BSTO—$MgSrZrTiO_6$, and combinations thereof. The thickness of the voltage tunable dielectric layer 1006 can range from about 0.1 $\mu$m to about 20 $\mu$m. Following is a list of some of the patents which discuss different aspects and capabilities of the tunable voltage tunable dielectric layer 1006 all of which are incorporated herein by reference: U.S. Pat. Nos. 5,312,790; 5,427,988; 5,486,491; 5,635,434; 5,830,591; 5,846,893; 5,766,697; 5,693,429 and 5,635,433.

As shown, the voltage-tunable capacitor 1000 has a gap 1010 formed between the metal electrodes 1002 and 1004. The width of the gap 1010 is optimized to increase the ratio of the maximum capacitance $C_{max}$ to the minimum capacitance $C_{min}$ ($C_{max}/C_{min}$) and to increase the quality factor (Q) of the device. The width of the gap 1010 has a strong influence on the $C_{max}/C_{min}$ parameters of the voltage-tunable capacitor 1000. The optimal width, g, is typically the width at which the voltage-tunable capacitor 1000 has a maximum $C_{max}/C_{min}$ and minimal loss tangent. In some applications, the voltage-tunable capacitor 1000 may have a gap 1010 in a range of 5–50 $\mu$m. The thickness of the tunable voltage tunable dielectric layer 1006 also has a strong influence on the $C_{max}/C_{min}$ parameters of the voltage-tunable capacitor 1000. The desired thickness of the voltage tunable dielectric layer 1006 is typically the thickness at which the voltage-tunable capacitor 1000 has a maximum $C_{max}/C_{min}$ and minimal loss tangent.

The length of the gap 1010 (e.g., straight gap 1010 (shown) or interdigital gap 1010 (not shown) is another dimension that strongly influences the design and functionality of the voltage-tunable capacitor 1000. In other words, variations in the length of the gap 1010 have a strong effect on the capacitance of the voltage-tunable capacitor 1000. For a desired capacitance, the length can be determined experimentally, or through computer simulation.

The electrodes 1002 and 1004 may be fabricated in any geometry or shape containing a gap 1010 of predetermined width and length. In the preferred embodiment, the electrode material is gold which is resistant to corrosion. However, other conductors such as copper, silver or aluminum, may also be used. Copper provides high conductivity, and would typically be coated with gold for bonding or nickel for soldering.

Following are some of the different advantages and features of the tunable patch antenna 300, 600 and 700:

The tunable patch antenna 300, 600 and 700 itself performs the frequency scanning such that there is no need for external filtering.

The tunable patch antenna 300, 600 and 700 is superior to the traditional tunable patch antennas that incorporate MEMS, ferrite diodes and semiconductor diodes because: (1) it has a very good power handling capability; (2) it can be used in a passive manner; (3) it is compact and lightweight; (4) it can be used in a planar fashion; and (5) it has fast switching speeds.

The typical tuning range for the traditional tunable patch antenna 100 operating around 1.75 GHz with only radiating edge loading is +/−80 MHz or 4–5%. In comparison, the tuning range for the tunable patch antenna 300, 600 and 700 with radiating edge loading and additional series capacitive links inserted has been increased to +/−170 MHz or ~10% which is more than double the tuning range of the traditional tunable patch antenna 100.

The tunable patch antenna 300, 600 and 700 enable the transmission of reception of high throughput and secure communication channels with enhanced interference and jamming suppression.

The tunable patch antenna 300, 600 and 700 can be conformal, quasi-planar structures that are mounted on a substantially horizontal surface or arbitrary curved support surface and still address the 30 MHz to 40 GHz ranges.

The size of the tunable patch antenna 300, 600 and 700 can be reduced in several ways: (1) by cutting notches into the non-radiating edges of the patches where the current flow is strongest; or (2) by placing a hole or holes in the center of the parts of the patch of the tunable patch antenna 300 600 and 700.

The tunable patch antenna 300, 600 and 700 can have patches or parts made by a mesh of wires or strips of metal to reduce weight.

While the present invention has been described in terms of its preferred embodiments, it will be apparent to those skilled in the art that various changes can be made to the disclosed embodiments without departing from the scope of the invention as set forth in the following claims.

What is claimed is:

1. A tunable patch antenna comprising:

a ground plane;

a substrate; and a patch which is located on said substrate which is located on said ground plane, said patch includes:

at least two parts that are connected to one another by at least one voltage-tunable series capacitor; and said at least two parts each has a radiating edge connected to at least one voltage-tunable edge capacitor.

2. The tunable patch antenna of claim 1, wherein said tunable patch antenna has a tuning range of about 30% of the center frequency of operation, because:

said at least one voltage-tunable series capacitor stores some of the magnetic field energy associated with said patch; and said at least one voltage-tunable edge capacitor stores some of the electrical field energy associated with said patch.

3. The tunable patch antenna of claim 1, wherein said patch receives a DC bias voltage and a radio frequency signal and then emits a beam having one of the following radiation patterns:

an omni-directional radiation pattern;

a vertically polarized radiation pattern;

a linear polarized radiation pattern;

a circular polarized radiation pattern; or an elliptical polarized radiation pattern.

4. The tunable patch antenna of claim 1, wherein each voltage-tunable series capacitor and each voltage-tunable edge capacitor is made in part from a tunable voltage tunable dielectric material.

5. The tunable patch antenna of claim 1, wherein a said tunable patch antenna has a shape that conforms to an arbitrary curved support surface.

6. The tunable patch antenna of claim 1, wherein a plurality of said tunable patch antennas are used to form a tunable patch array antenna.

7. A method for tuning a frequency of a tunable patch antenna, said method comprising the steps of:

applying a radio frequency signal to said tunable patch antenna, wherein said tunable patch antenna includes:

a ground plane;

a substrate; and a patch which is located on said substrate which is located on said ground plane, said patch includes:

at least two parts that are connected to one another by at least one voltage-tunable series capacitor; and said at least two parts each has a radiating edge connected to at least one voltage-tunable edge capacitor; and applying a DC bias voltage to said at least one voltage-tunable series capacitor and said at least one voltage-tunable edge capacitor to tune the frequency of the tunable patch antenna.

8. The method of claim 7, wherein said tunable patch antenna has a frequency tuning range of about 30% of the center frequency of operation, because:

said at least one voltage-tunable series capacitor stores a portion of the magnetic field energy associated with said patch; and said at least one voltage-tunable edge capacitor stores a portion of the electrical field energy associated with said patch.

9. The method of claim 7, wherein said tunable patch antenna is capable of emitting a beam having one of the following radiation patterns:

an omni-directional radiation pattern;

a vertically polarized radiation pattern;

a linear polarized radiation pattern; or a circular/elliptical polarized radiation pattern.

10. The method of claim 7, wherein each voltage-tunable series capacitor and each voltage-tunable edge capacitor is made in part from a tunable voltage tunable dielectric material.

11. A radio comprising:

a transmitter; and a receiver, wherein said transmitter and said receiver each are attached to one or more tunable patch antennas, each tunable patch antenna includes:

a ground plane;

a substrate; and a patch which is located on said substrate which is located on said ground plane, said patch includes:

at least two parts that are connected to one another by at least one voltage-tunable series capacitor; and said at least two parts each has a radiating edge connected to at least one voltage-tunable edge capacitor.

12. The radio of claim 11, wherein each tunable patch antenna has a tuning range of about 30% of the center frequency of operation, because:

said at least one voltage-tunable series capacitor stores some of the magnetic field energy associated with said patch; and said at least one voltage-tunable edge capacitor stores some of the electrical field energy associated with said patch.

13. The radio of claim 11, wherein said patch receives a DC bias voltage and a radio frequency signal and then emits a beam having one of the following radiation patterns:

an omni-directional radiation pattern;

a vertically polarized radiation pattern;

a linear polarized radiation pattern; or a circular/elliptical polarized radiation pattern.

14. The radio of claim 11, wherein each voltage-tunable series capacitor and each voltage-tunable edge capacitor is made in part from a tunable voltage tunable dielectric material.

15. The radio of claim 11, wherein:

said transmitter is attached to a plurality of said tunable patch antennas that form a tunable patch array antenna; and said receiver is attached to a plurality of said tunable patch antennas that form a tunable patch array antenna.

16. A tunable patch antenna comprising:

a ground plane;

a substrate; and a patch which is located on said substrate which is located on said ground plane, said patch includes:

a first part and a second part that are connected to one another by at least one voltage-tunable series capacitor;

said first part has a radiating edge connected to at least one voltage-tunable edge capacitor each of which is connected to physical ground;

said second part has a radiating edge connected to at least one voltage-tunable edge capacitor each of which are connected to RF ground;

wherein a radio frequency signal is applied to said first part and/or said second part of said patch; and wherein a DC bias voltage is also applied to said at least one voltage-tunable series capacitor and said at least one voltage-tunable edge capacitor in order to tune the frequency of the tunable patch antenna.

17. The tunable patch antenna of claim 16, wherein said tunable patch antenna has a tuning range up to 30% of the center frequency of operation, because:

said at least one voltage-tunable series capacitor stores some of the magnetic field energy associated with said patch; and said at least one voltage-tunable edge capacitor stores some of the electrical field energy associated with said patch.

18. The tunable patch antenna of claim 16, wherein said patch emits a beam having one of the following radiation patterns:

an omni-directional radiation pattern;

a vertically polarized radiation pattern;

a linear polarized radiation pattern; or a circular/elliptical polarized radiation pattern.

19. The tunable patch antenna of claim 16, wherein each voltage-tunable series capacitor and each voltage-tunable edge capacitor is made in part from a tunable voltage tunable dielectric material.

20. The tunable patch antenna of claim 16, wherein a said tunable patch antenna has a shape that conforms to an arbitrary curved support surface.

21. The tunable patch antenna of claim 16, wherein a plurality of said tunable patch antennas are used to form a tunable patch array antenna.

22. A tunable patch antenna comprising:

a ground plane;

a substrate; and a patch which is located on said substrate which is located on said ground plane, said patch includes:

a first part and a second part that are connected to one another by at least one pair of voltage-tunable series capacitors that are connected to physical ground;

said first part has a radiating edge connected to at least one voltage-tunable edge capacitor each of which is connected to physical ground;

said second part has a radiating edge connected to at least one voltage-tunable edge capacitor each of which is connected to physical ground;

wherein a radio frequency signal is applied to said first part and/or said second part of said patch; and wherein a DC bias voltage is also applied to said at least one voltage-tunable series capacitor and said at least one voltage-tunable edge capacitor in order to tune the frequency of the tunable patch antenna.

23. The tunable patch antenna of claim 22, wherein said tunable patch antenna has a tuning range of 30% of the center frequency of operation, because:

said at least one pair of voltage-tunable series capacitors stores some of the magnetic field energy associated with said patch; and said at least one voltage-tunable edge capacitor stores some of the electrical field energy associated with said patch.

24. The tunable patch antenna of claim 22, wherein said patch emits a beam having one of the following radiation patterns:

an omni-directional radiation pattern;

a vertically polarized radiation pattern;

a linear polarized radiation pattern; or a circular/elliptical polarized radiation pattern.

25. The tunable patch antenna of claim 22, wherein each pair of voltage-tunable series capacitors and each voltage-tunable edge capacitor is made in part from a tunable voltage tunable dielectric material.

26. The tunable patch antenna of claim 22, wherein a said tunable patch antenna has a shape that conforms to an arbitrary curved support surface.

27. The tunable patch antenna of claim 22, wherein a plurality of said tunable patch antennas are used to form a tunable patch array antenna.

* * * * *